US009694268B2

(12) United States Patent
Vincent

(10) Patent No.: US 9,694,268 B2
(45) Date of Patent: Jul. 4, 2017

(54) VOLLEYBALL PRACTICE ASSEMBLY

(71) Applicant: Jacob Vincent, Huntington Beach, CA (US)

(72) Inventor: Jacob Vincent, Huntington Beach, CA (US)

( * ) Notice: Subject to any disclaimer, the term of this patent is extended or adjusted under 35 U.S.C. 154(b) by 0 days.

(21) Appl. No.: 14/859,454

(22) Filed: Sep. 21, 2015

(65) Prior Publication Data

US 2017/0080318 A1 Mar. 23, 2017

(51) Int. Cl.
*A63B 69/00* (2006.01)
*A63B 61/00* (2006.01)

(52) U.S. Cl.
CPC ..... *A63B 69/0095* (2013.01); *A63B 61/006* (2013.01)

(58) Field of Classification Search
CPC ..... A63B 61/006; F41J 5/04
USPC ..... 473/462, 17, 190, 454, 426, 140, 459, 473/473, 476, 422; 273/378, 371–377, 273/407, 386
See application file for complete search history.

(56) References Cited

U.S. PATENT DOCUMENTS 4,577,865 A 3/1986 Shisido
5,553,860 A * 9/1996 Zelikovich ..... F41J 5/04 273/371
D378,103 S 2/1997 Yiu
5,605,336 A 2/1997 Gaoiran et al.
7,850,535 B2 * 12/2010 Noble ..... A63B 24/0021 273/331
7,998,003 B2 8/2011 Orr
7,998,004 B2 * 8/2011 Klein ..... A63B 24/0021 473/476
2008/0254866 A1 * 10/2008 Young ..... A63B 24/0021 463/25
2008/0265511 A1 * 10/2008 Shum ..... F41J 7/06 273/392
2009/0117525 A1 5/2009 Bavaro et al.
2010/0004075 A1 * 1/2010 Maeda ..... A63B 24/0021 473/436
2012/0197418 A1 8/2012 Wilkes et al.
2013/0157788 A1 6/2013 Moorre

FOREIGN PATENT DOCUMENTS

WO WO2007009072 1/2007

* cited by examiner

*Primary Examiner* — Aarti B Berdichevsky
*Assistant Examiner* — Rayshun Peng

(57) ABSTRACT

A volleyball practice assembly includes a target unit that may be mounted to a support thereby facilitating the target unit to have a ball launched toward the target unit. The target unit registers when the ball strikes the target unit thereby facilitating the target unit to aid in accuracy training with respect to the ball. A control circuit is coupled to the target unit and the control circuit detects when the ball strikes the target unit. A remote unit is provided. The remote unit is in communication with the target unit such that the remote unit controls operational parameters of the target unit.

14 Claims, 6 Drawing Sheets

VOLLEYBALL PRACTICE ASSEMBLY

BACKGROUND OF THE DISCLOSURE

Field of the Disclosure

The disclosure relates to volleyball devices and more particularly pertains to a new volleyball device for training launching accuracy with a volleyball.

SUMMARY OF THE DISCLOSURE

An embodiment of the disclosure meets the needs presented above by generally comprising a target unit that may be mounted to a support thereby facilitating the target unit to have a ball launched toward the target unit. The target unit registers when the ball strikes the target unit thereby facilitating the target unit to aid in accuracy training with respect to the ball. A control circuit is coupled to the target unit and the control circuit detects when the ball strikes the target unit. A remote unit is provided. The remote unit is in communication with the target unit such that the remote unit controls operational parameters of the target unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
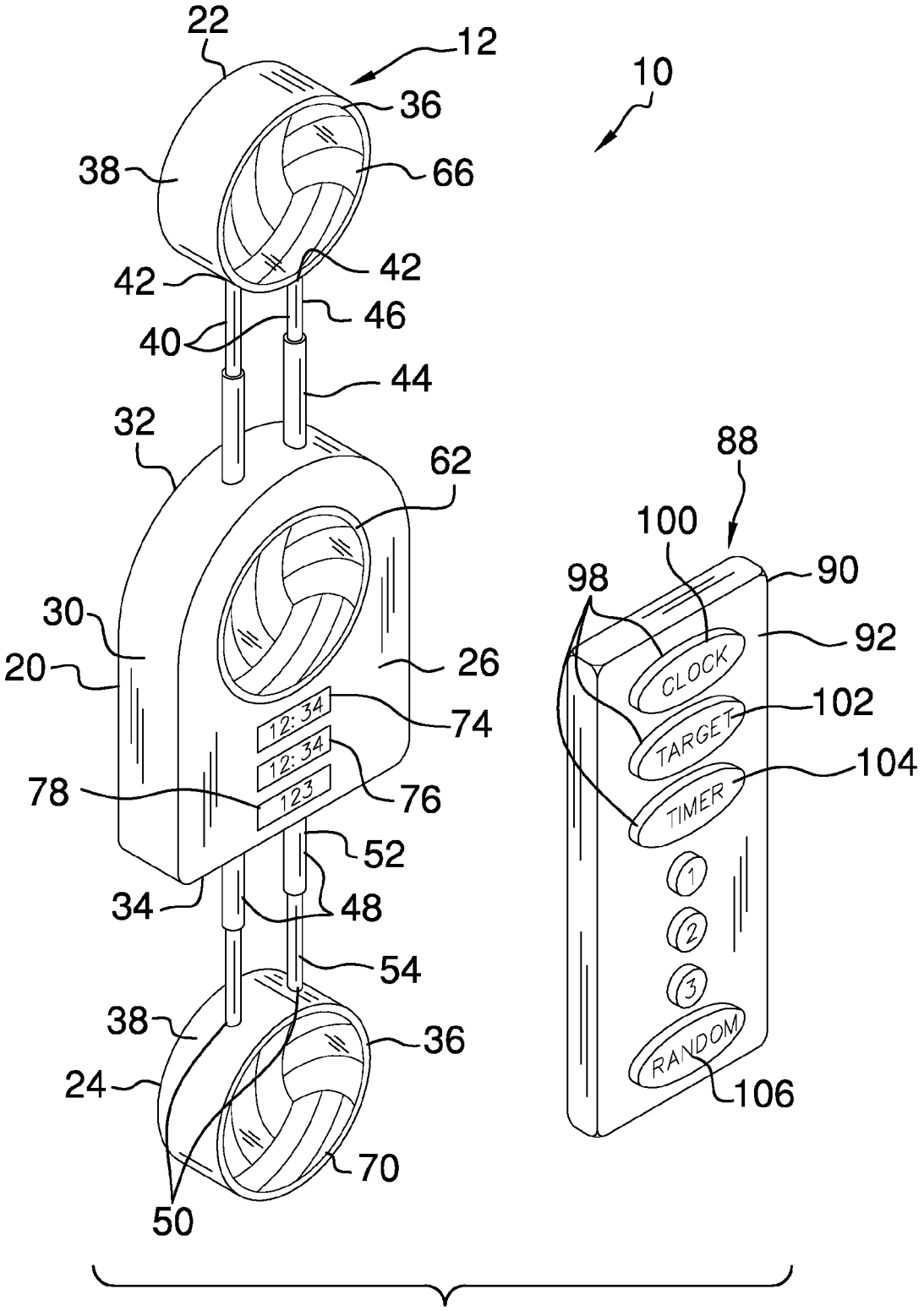
FIG. 1 is a perspective view of a volleyball practice assembly according to an embodiment of the disclosure.
Figure 2:
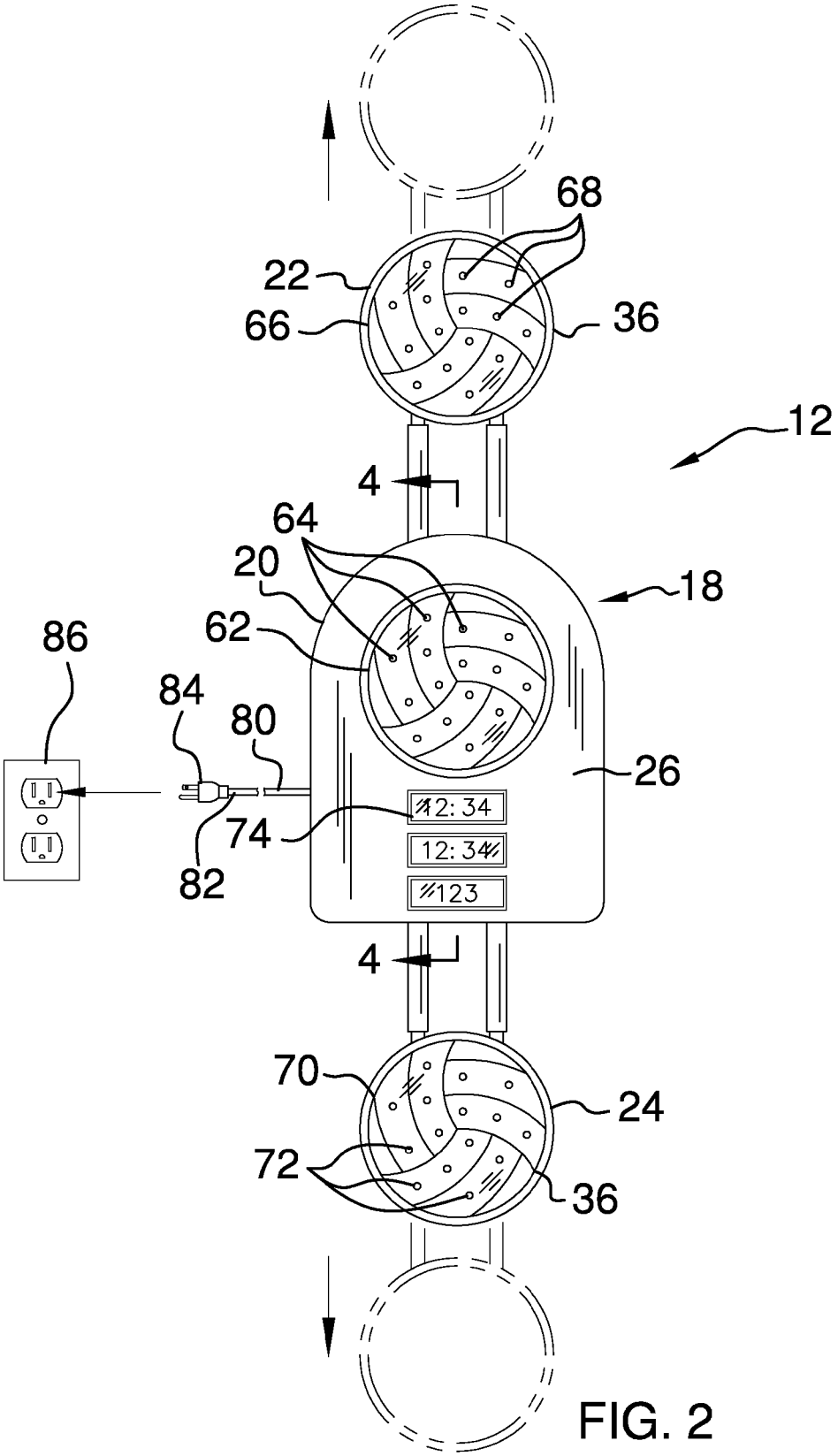
FIG. 2 is a front view of an embodiment of the disclosure.
Figure 3:
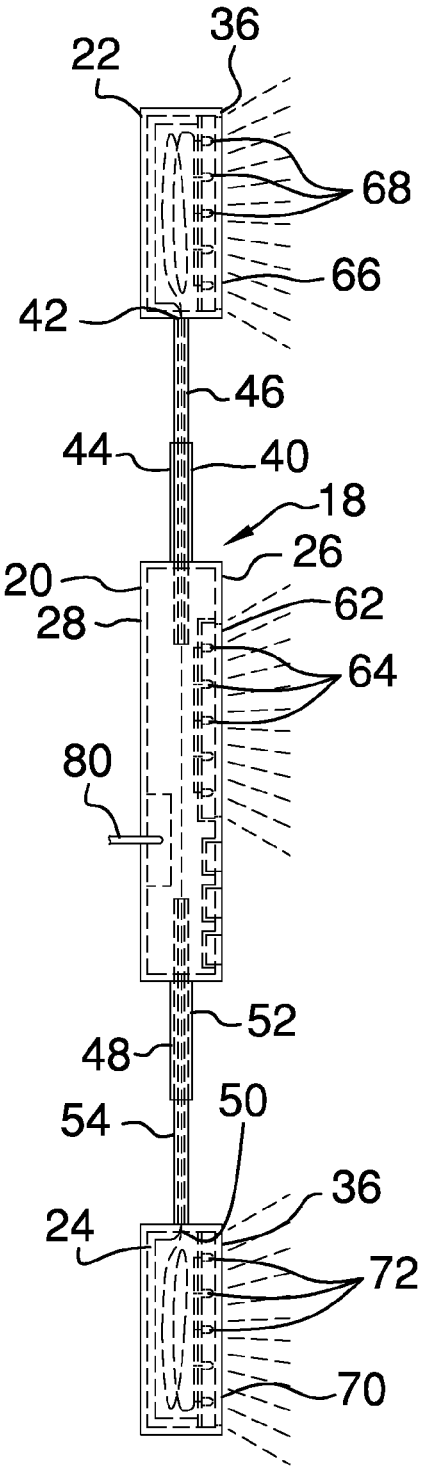
FIG. 3 is a right side phantom view of an embodiment of the disclosure.
Figure 4:
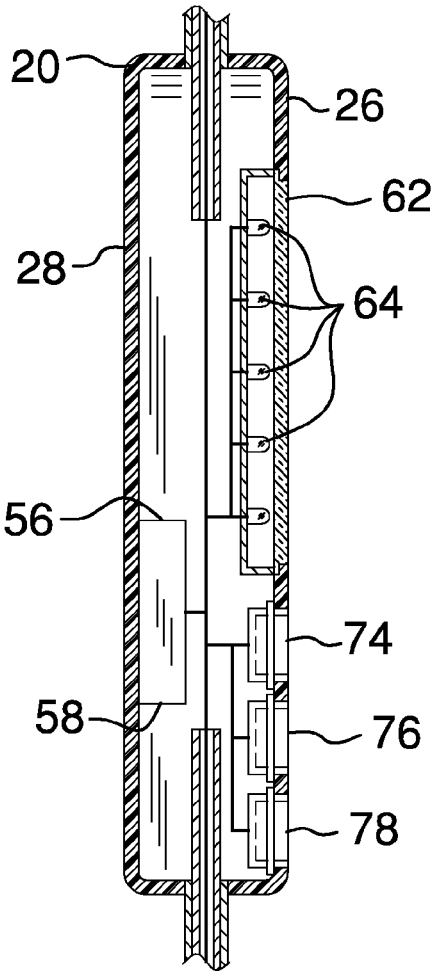
FIG. 4 is a cross sectional view taken along line 4-4 of FIG. 2 of an embodiment of the disclosure.
Figure 5:
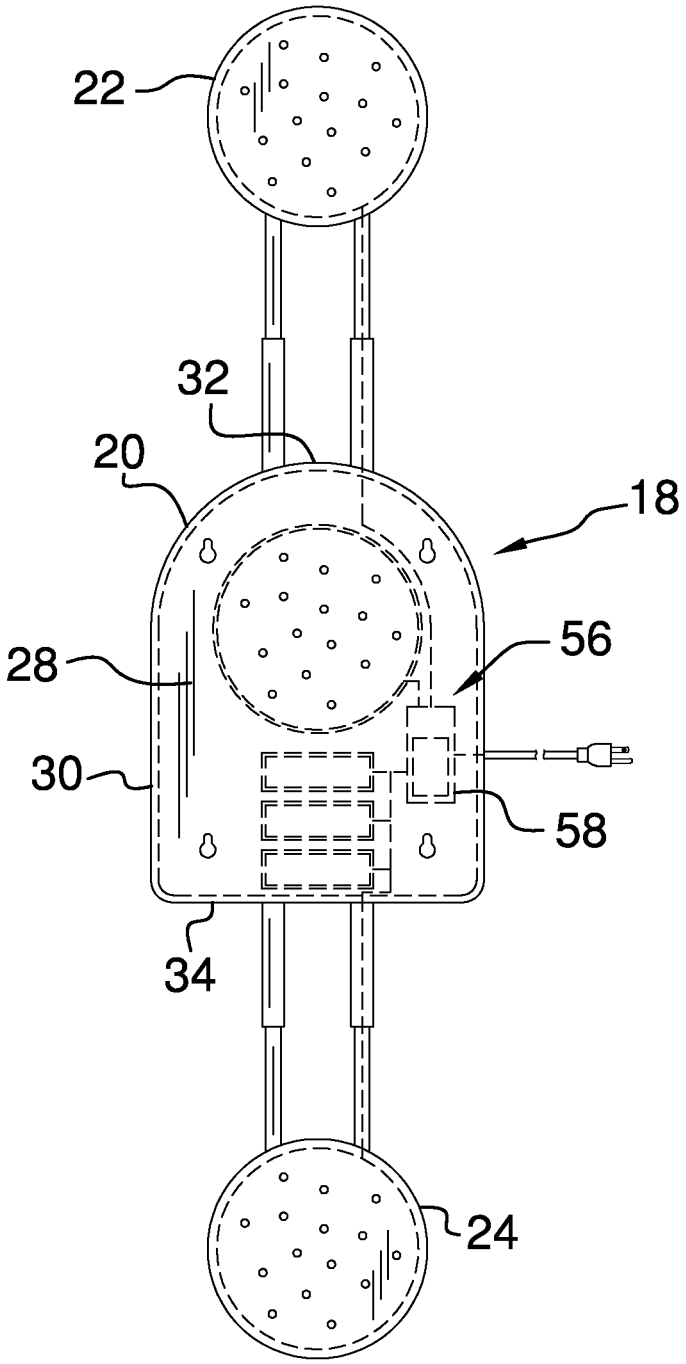
FIG. 5 is a back phantom view of an embodiment of the disclosure.
Figure 6:
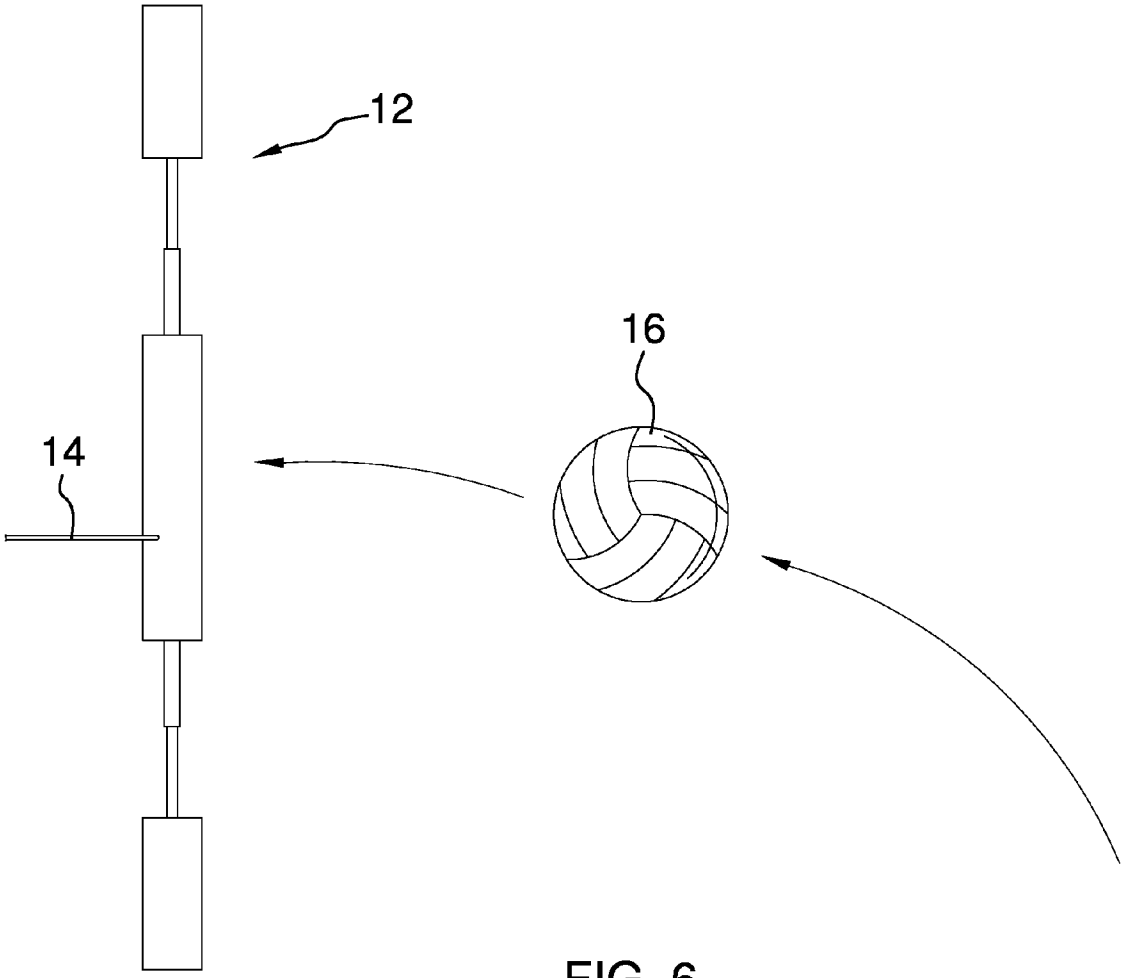
FIG. 6 is a perspective in-use view of an embodiment of the disclosure.
Figure 7:
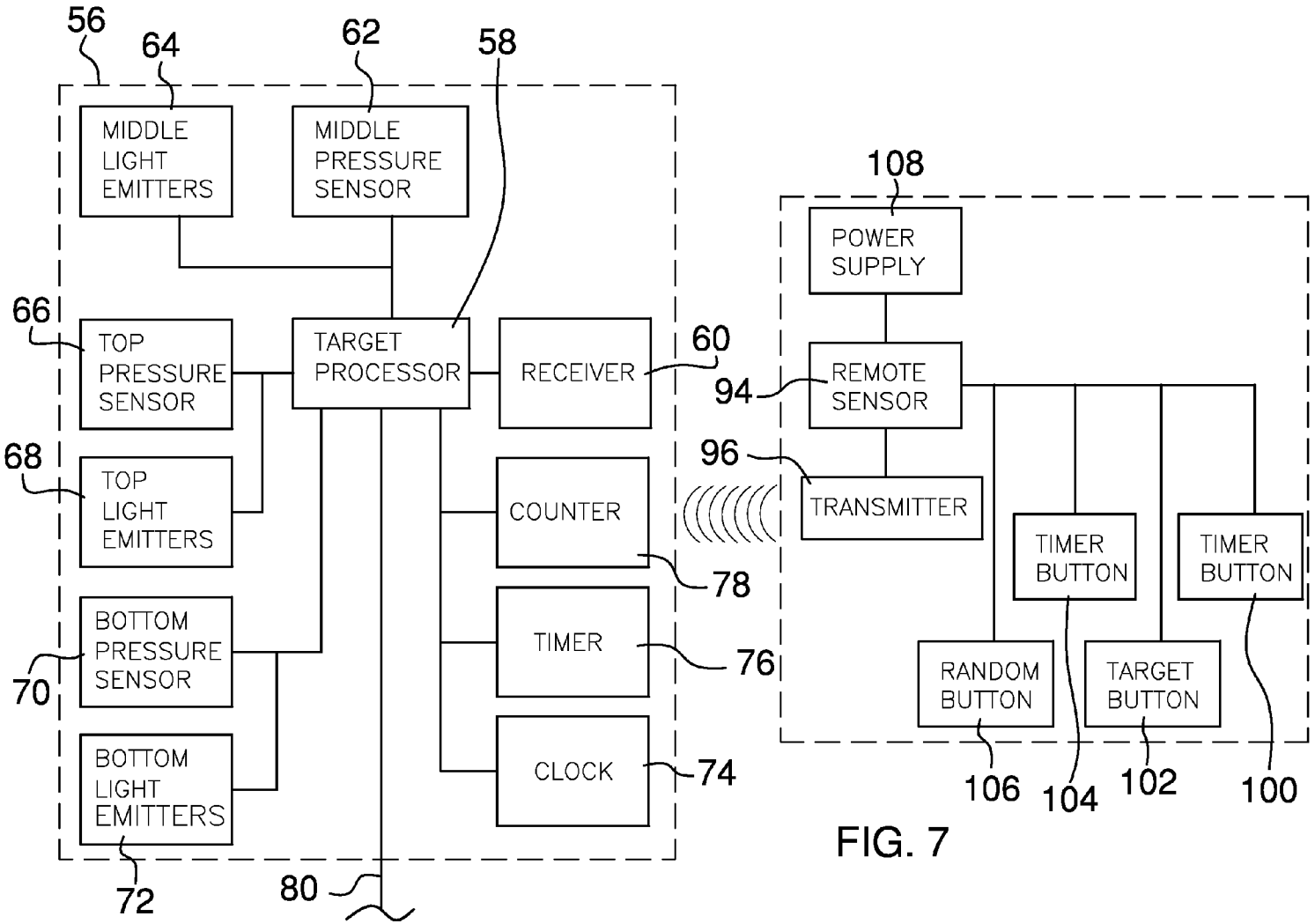
FIG. 7 is a schematic view of an embodiment of the disclosure.

With reference now to the drawings, and in particular to FIGS. 1 through 7 thereof, a new volleyball device embodying the principles and concepts of an embodiment of the disclosure and generally designated by the reference numeral 10 will be described.

As best illustrated in FIGS. 1 through 7, the volleyball practice assembly 10 generally comprises a target unit 12 that may be mounted to a support 14 thereby facilitating the target unit 12 to have a ball 16 launched toward the target unit 12. The support 14 may be a wall or a basketball hoop. The ball 16 may be a volleyball or the like and the target unit 12 may be used to facilitate target practice for setting and passing in the game of volleyball. The target unit 12 registers when the ball 16 strikes the target unit 12 thereby facilitating the target unit 12 to aid in accuracy training with respect to the ball 16.

The target unit 12 comprises a housing 18 that has a middle section 20, a top section 22 and a bottom section 24. The middle section 20 has a front wall 26, a back wall 28 and a peripheral edge 30 extending between the front wall 26 and the back wall 28. The peripheral edge 30 has a top side 32 and a bottom side 34 and the back wall 28 may be coupled to the support 14. Each of the top section 22 and the bottom section 24 has a forward wall 36 and a perimeter edge 38.

A pair of top supports 40 is provided and each of the top supports 40 is coupled to and extends upwardly from the top side 32 of the middle section 20. Each of the top supports 40 has a distal end 42 with respect to the middle section 20. Each of the top supports 40 has a first section 44 that is slidably coupled to a second section 46. Thus, each of the top supports 40 has a telescopically adjustable length. The perimeter edge 38 corresponding to the top section 22 of the housing 18 is coupled to the distal end 42 of each of the top supports 40. Thus, the top section 22 is selectively spaced from the middle section 20.

A pair of bottom supports 48 is provided and each of the bottom supports 48 is coupled to and extends upwardly from the bottom side 34 of the middle section 20. Each of the bottom supports 48 has a distal end 50 with respect to the middle section 20. Each of the bottom supports 48 has a first section 52 that is slidably coupled to a second section 54. Thus, each of the bottom supports 48 has a telescopically adjustable length. The perimeter edge 38 corresponding to the bottom section 24 of the housing 18 is coupled to the distal end 50 of each of the bottom supports 48 such that the bottom section 24 is selectively spaced from the middle section 20.

A control circuit 56 is coupled to the target unit 12 and the control circuit 56 detects when the ball 16 strikes the target unit 12. The control circuit 56 comprises a target processor 58 that is positioned within the middle section 20. The target processor 58 may comprise an electronic processor or the like. A receiver 60 is positioned within the middle section 20 and the receiver 60 is electrically coupled to the target processor 58. The receiver 60 may comprise a radio frequency receiver or the like.

A middle pressure sensor 62 is coupled to the front wall 26 of the middle section 20. The middle pressure sensor 62 may be struck by the ball 16 thereby facilitating the middle pressure sensor 62 to detect the impact of the ball 16. The middle pressure sensor 62 is electrically coupled to the target processor 58. A plurality of middle light emitters 64 is provided and each of the middle light emitters 64 is coupled to the middle pressure sensor 62. Each of the middle light emitters 64 selectively emits light. Each of the middle light emitters 64 is electrically coupled to the target processor 58 and each of the middle light emitters 64 may comprise an LED or the like.

A top pressure sensor 66 is coupled to the forward wall 36 corresponding to the top section 22. The top pressure sensor 66 may be struck by the ball 16 thereby facilitating the top pressure sensor 66 to detect the impact of the ball 16. The top pressure sensor 66 is electrically coupled to the target processor 58. A plurality of top light emitters 68 is provided and each of the top light emitters 68 is coupled to the top pressure sensor 66. Each of the top light emitters 68 selectively emits light. Each of the top light emitters 68 is electrically coupled to the target processor 58 and each of the top light emitters 68 may comprise an LED or the like.

A bottom pressure sensor 70 is coupled to the forward wall 36 corresponding to the bottom section 24. The bottom pressure sensor 70 may be struck by the ball 16 thereby facilitating the bottom pressure sensor 70 to detect the impact of the ball 16. The bottom pressure sensor 70 is electrically coupled to the target processor 58. A plurality of bottom light emitters 72 is provided and each of the bottom light emitters 72 is coupled to the bottom pressure sensor 70. Each of the bottom light emitters 72 selectively emits light. Each of the bottom light emitters 72 is electrically coupled to the target processor 58 and each of the bottom light emitters 72 may comprise an LED or the like.

A clock 74 is coupled to the front wall 26 of the middle section 20 and the clock 74 is electrically coupled to the target processor 58. The clock 74 displays a time of day and the clock 74 may comprise a digital clock or the like. A timer 76 is coupled to the front wall 26 of the middle section 20 and the timer 76 is electrically coupled to the target processor 58. The timer 76 displays a duration of time between consecutive launches of the ball 16 striking the target unit 12. The timer 76 may comprise a digital timer or the like.

A counter 78 is coupled to the front wall 26 of the middle section 20 and the counter 78 is electrically coupled to the target processor 58. The counter 78 may display a number of times the ball 16 strikes the target unit 12 and the counter 78 may comprise a digital counter or the like. A power cord 80 extends outwardly from the middle section 20 and the power cord 80 is electrically coupled to the target processor 58. The power cord 80 has a distal end 82 with respect to the middle section 20 and the distal end 82 has a plug 84 that is electrically coupled thereto. The plug 84 may be electrically coupled to a power source 86 and the power source 86 may comprise an electrical outlet or the like.

A remote unit 88 is provided and the remote unit 88 may be carried. The remote unit 88 is in communication with the target unit 12 such that the remote unit 88 controls operational parameters of the target unit 12. The remote unit 88 comprises a remote housing 90 that has a top wall 92. A remote processor 94 is positioned within the remote housing 90 and the remote processor 94 may comprise an electronic processor or the like.

A transmitter 96 is positioned within the remote housing 90. The transmitter 96 is electrically coupled to the remote processor 94. The transmitter 96 is in electrical communication with the receiver 60. The transmitter 96 may comprise a radio frequency transmitter or the like.

A plurality of buttons 98 is provided and each of the buttons 98 is coupled to the top wall 92 of the remote housing 90 such that each of the buttons 88 may be manipulated. Each of the buttons 88 is electrically coupled to the remote processor 94 and each of the buttons 88 controls the operational parameters of the target unit 12. The plurality of buttons 88 may comprise a clock button 100, a target button 102, a timer button 104 and a random button 106. A power supply 108 is positioned within the remote housing 90 and the power supply 108 is electrically coupled to the remote processor 94. The power supply 108 comprises at least one battery.

In use, the middle section 20 is coupled to the support and each of the top section 22 and the bottom section 24 are manipulated to be spaced from the middle section 20. The target button 102 is manipulated to actuate a selected one of the top light emitters 68, the middle light emitters 64 or the bottom light emitters 72. The ball 16 is launched toward the actuated light emitters 64,68,72 in an attempt to strike the corresponding top pressure sensor 66, the middle pressure sensor 62 or the bottom pressure sensor 70. The clock button 100 is manipulated to actuate the clock 74 and the timer button 104 is manipulated to actuate the timer 76. The random button 106 is actuated to randomly actuate the top light emitters 68, the middle light emitters 64 and the bottom light emitters 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A volleyball practice assembly comprising:

a target unit being configured to be mounted to a support thereby facilitating said target unit to have a ball launched toward said target unit, said target unit being configured to register when the ball strikes said target unit thereby facilitating said target unit to aid in accuracy training with respect to the ball, said target unit including a housing having a middle section, a top section and a bottom section, said middle section having a front wall, a back wall and a peripheral edge extending between said front wall and said back wall, said peripheral edge having a top side and a bottom side, said back wall being configured to be coupled to the support, each of said top section and said bottom section having a forward wall and a perimeter edge;

a control circuit being coupled to said target unit wherein said control circuit is configured to detect when the ball strikes said target unit;

a remote unit being configured to be carried, said remote unit being in communication with said target unit such that said remote unit controls operational parameters of said target unit;

a pair of top supports, each of said top supports being coupled to and extending upwardly from said top side of said middle section, each of said top supports having a distal end with respect to said middle section;

each of said top supports having a first section being slidably coupled to a second section such that each of said top supports has a telescopically adjustable length; and said perimeter edge corresponding to said top section of said housing being coupled to said distal end of each of said top supports such that said top section is selectively spaced from said middle section.

2. A volleyball practice assembly comprising:

a target unit being configured to be mounted to a support thereby facilitating said target unit to have a ball launched toward said target unit, said target unit being configured to register when the ball strikes said target unit thereby facilitating said target unit to aid in accuracy training with respect to the ball, said target unit including a housing having a middle section, a top section and a bottom section, said middle section having a front wall, a back wall and a peripheral edge extending between said front wall and said back wall, said peripheral edge having a top side and a bottom side, said back wall being configured to be coupled to the support, each of said top section and said bottom section having a forward wall and a perimeter edge;

a control circuit being coupled to said target unit wherein said control circuit is configured to detect when the ball strikes said target unit;

a remote unit being configured to be carried, said remote unit being in communication with said target unit such that said remote unit controls operational parameters of said target unit;

a pair of bottom supports, each of said bottom supports being coupled to and extending upwardly from said bottom side of said middle section, each of said bottom supports having a distal end with respect to said middle section;

each of said bottom supports having a first section being slidably coupled to a second section such that each of said bottom supports has a telescopically adjustable length; and said perimeter edge corresponding to said bottom section of said housing being coupled to said distal end of each of said bottom supports such that said bottom section is selectively spaced from said middle section.

3. The assembly according to claim 1, wherein:

said target unit includes a middle section, said middle section having a front wall; and said control circuit comprises:

a target processor being positioned within said middle section; and a receiver being positioned within said middle section, said receiver being electrically coupled to said target processor.

4. The assembly according to claim 3, further comprising:

a middle pressure sensor being coupled to said front wall of said middle section wherein said middle pressure sensor is configured to be struck by the ball thereby facilitating said middle pressure sensor to detect the impact of the ball, said middle pressure sensor being electrically coupled to said target processor; and a plurality of middle light emitters, each of said middle light emitters being coupled to said middle pressure sensor wherein each of said middle light emitters is configured to selectively emit light, each of said middle light emitters being electrically coupled to said target processor.

5. The assembly according to claim 3, further comprising:

a top pressure sensor being coupled to said forward wall corresponding to said top section wherein said top pressure sensor is configured to be struck by the ball thereby facilitating said top pressure sensor to detect the impact of the ball, said top pressure sensor being electrically coupled to said target processor; and a plurality of top light emitters, each of said top light emitters being coupled to said top pressure sensor wherein each of said top light emitters is configured to selectively emit light, each of said top light emitters being electrically coupled to said target processor.

6. The assembly according to claim 3, further comprising:

a bottom pressure sensor being coupled to said forward wall corresponding to said bottom section wherein said bottom pressure sensor is configured to be struck by the ball thereby facilitating said bottom pressure sensor to detect the impact of the ball, said bottom pressure sensor being electrically coupled to said target processor; and a plurality of bottom light emitters, each of said bottom light emitters being coupled to said bottom pressure sensor wherein each of said bottom light emitters is configured to selectively emit light, each of said bottom light emitters being electrically coupled to said target processor.

7. The assembly according to claim 3, further comprising a clock being coupled to said front wall of said middle section, said clock being electrically coupled to said target processor, said clock being configured to display a time of day.

8. The assembly according to claim 3, further comprising a timer being coupled to said front wall of said middle section, said timer being electrically coupled to said target processor, said timer being configured to display a duration of time between target unit being struck by the ball.

9. The assembly according to claim 3, further comprising a counter being coupled to said front wall of said middle section, said counter being electrically coupled to said target processor, said counter being configured to display a number of times the ball strikes said target unit.

10. The assembly according to claim 3, further comprising a power cord extending outwardly from said middle section, said power cord being electrically coupled to said target processor, said power cord having a distal end with respect to said middle section, said distal end having a plug being electrically coupled thereto, said plug being configured to be electrically coupled to a power source.

11. The assembly according to claim 1, wherein said remote unit comprises:

a remote housing having a top wall;

a remote processor being positioned within said remote housing; and a transmitter being positioned within said remote housing, said transmitter being electrically coupled to said remote processor, said transmitter being in electrical communication with said receiver.

12. The assembly according to claim 11, further comprising a plurality of buttons, each of said buttons being coupled to said top wall wherein each of said buttons is configured to be manipulated, each of said buttons being electrically coupled to said remote processor, each of said buttons controlling the operational parameters of said target unit.

13. The assembly according to claim 11, further comprising a power supply being positioned within said remote housing, said power supply being electrically coupled to said remote processor, said power supply comprising at least one battery.

14. A volleyball practice assembly comprising:

a target unit being configured to be mounted to a support thereby facilitating said target to have a ball launched toward said target unit, said target unit being configured to register when the ball strikes said target unit thereby facilitating said target unit to aid in accuracy training with respect to the ball, said target unit comprising:

a housing having a middle section, a top section and a bottom section, said middle section having a front wall, a back wall and a peripheral edge extending between said front wall and said back wall, said peripheral edge having a top side and a bottom side, said back wall being configured to be coupled to the support, each of said top section and said bottom section having a forward wall and a perimeter edge, a pair of top supports, each of said top supports being coupled to and extending upwardly from said top side of said middle section, each of said top supports having a distal end with respect to said middle section, each of said top supports having a first section being slidably coupled to a second section such that each of said top supports has a telescopically adjustable length, said peripheral wall corresponding to said top section of said housing being coupled to said distal end of each of said top supports such that said top section is selectively spaced from said middle section, a pair of bottom supports, each of said bottom supports being coupled to and extending upwardly from said bottom side of said middle section, each of said bottom supports having a distal end with respect to said middle section, each of said bottom supports having a first section being slidably coupled to a second section such that each of said bottom supports has a telescopically adjustable length, said peripheral wall corresponding to said bottom section of said housing being coupled to said distal end of each of said bottom supports such that said bottom section is selectively spaced from said middle section, a control circuit being coupled to said target unit wherein said control circuit is configured to detect when the ball strikes said target unit, said control circuit comprising:

a target processor being positioned within said middle section, a receiver being positioned within said middle section, said receiver being electrically coupled to said target processor, a middle pressure sensor being coupled to said front wall of said middle section wherein said middle pressure sensor is configured to be struck by the ball thereby facilitating said middle pressure sensor to detect the impact of the ball, said middle pressure sensor being electrically coupled to said target processor, a plurality of middle light emitters, each of said middle light emitters being coupled to said middle pressure sensor wherein each of said middle light emitters is configured to selectively emit light, each of said middle light emitters being electrically coupled to said target processor, a top pressure sensor being coupled to said forward wall corresponding to said top section wherein said top pressure sensor is configured to be struck by the ball thereby facilitating said top pressure sensor to detect the impact of the ball, said top pressure sensor being electrically coupled to said target processor, a plurality of top light emitters, each of said top light emitters being coupled to said top pressure sensor wherein each of said top light emitters is configured to selectively emit light, each of said top light emitters being electrically coupled to said target processor, a bottom pressure sensor being coupled to said forward wall corresponding to said bottom section wherein said bottom pressure sensor is configured to be struck by the ball thereby facilitating said bottom pressure sensor to detect the impact of the ball, said bottom pressure sensor being electrically coupled to said target processor, a plurality of bottom light emitters, each of said bottom light emitters being coupled to said bottom pressure sensor wherein each of said bottom light emitters is configured to selectively emit light, each of said bottom light emitters being electrically coupled to said target processor, a clock being coupled to said front wall of said middle section, said clock being electrically coupled to said target processor, said clock being configured to display a time of day, a timer being coupled to said front wall of said middle section, said timer being electrically coupled to said target processor, said timer being configured to display a duration of time between target unit being struck by the ball, a counter being coupled to said front wall of said middle section, said counter being electrically coupled to said target processor, said counter being configured to display a number of times the ball strikes said target unit, and a power cord extending outwardly from said middle section, said power cord being electrically coupled to said target processor, said power cord having a distal end with respect to said middle section, said distal end having a plug being electrically coupled thereto, said plug being configured to be electrically coupled to a power source; and a remote unit being configured to be carried, said remote unit being in communication with said target unit such that said remote unit controls operational parameters of said target unit, said remote unit comprising:

a remote housing having a top wall, a remote processor being positioned within said remote housing, a transmitter being positioned within said remote housing, said transmitter being electrically coupled to said remote processor, said transmitter being in electrical communication with said receiver, a plurality of buttons, each of said buttons being coupled to said top wall wherein each of said buttons is configured to be manipulated, each of said buttons being electrically coupled to said remote processor, each of said buttons controlling the operational parameters of said target unit, and a power supply being positioned within said remote housing, said power supply being electrically coupled to said remote processor, said power supply comprising at least one battery.

* * * * *